United States Patent [19]

Kulcsár et al.

[11] Patent Number: 4,838,433

[45] Date of Patent: Jun. 13, 1989

[54] PROCESS FOR THE SEPARATION OF ROCK REFUSE AND COAL PRODUCTS

[75] Inventors: Gyula Kulcsár, both of Tatabánya; András Solymos, both of Tatabánya I., Hungary

[73] Assignee: Tatabányai Szénbányák, Tatabánya, Hungary

[21] Appl. No.: 22,478

[22] Filed: Mar. 6, 1987

Related U.S. Application Data

[63] Continuation of Ser. No. 670,113, Jan. 8, 1984, abandoned, which is a continuation of Ser. No. 552,841, Nov. 14, 1983, abandoned, which is a continuation of Ser. No. 423,946, Sep. 27, 1982, abandoned, which is a continuation of Ser. No. 319,375, Nov. 9, 1981, abandoned, which is a continuation of Ser. No. 130,396, Mar. 14, 1980, abandoned.

[30] Foreign Application Priority Data

Apr. 11, 1979 [HU] Hungary ..... TA 1516

[51] Int. Cl.[4] ..... B03B 5/34; B03B 5/44

[52] U.S. Cl. ..... 209/3; 209/17; 209/211

[58] Field of Search ..... 209/211, 17, 172.5, 209/172, 173, 3

[56] References Cited

U.S. PATENT DOCUMENTS

| | | | |
|---|---|---|---|
| 2,497,790 | 2/1956 | Pauvrasseau | 209/172.5 |
| 2,693,878 | 11/1954 | Driessen et al. | 209/172.5 |
| 2,754,963 | 7/1956 | Krijgsman et al. | 209/172.5 |
| 2,889,925 | 9/1959 | Fontein | 209/172.5 |
| 3,031,074 | 4/1962 | Osawa . | |
| 3,037,630 | 6/1962 | Bixby | 209/393 |
| 3,235,072 | 2/1966 | Nelson | 209/172.5 |
| 3,379,308 | 4/1968 | Horiuchi | 209/211 |
| 3,794,162 | 2/1974 | Miller | 209/172.5 |
| 3,887,456 | 6/1975 | Loughner | 209/211 |
| 3,926,787 | 12/1975 | Gay | 209/211 |
| 4,028,228 | 6/1977 | Ferris et al. | 209/172.5 |
| 4,364,822 | 12/1982 | Rich | 209/172.5 |

FOREIGN PATENT DOCUMENTS

| | | | |
|---|---|---|---|
| 627423 | 8/1949 | United Kingdom | 209/211 |
| 655957 | 8/1951 | United Kingdom | 209/172.5 |
| 664290 | 1/1952 | United Kingdom | 209/172.5 |
| 666801 | 2/1952 | United Kingdom | 209/172.5 |
| 2046630 | 11/1980 | United Kingdom | 209/172.5 |

*Primary Examiner*—David L. Lacey
*Assistant Examiner*—Thomas M. Lithgow
*Attorney, Agent, or Firm*—Schweitzer & Cornman

[57] ABSTRACT

The invention relates to a process for separating rock refuse of coal mining and products of coal deposits with rock intercalation, the coal contents of which being advantageously less, than 50%, into parts being rich and poor in coal, respectively, in a given case in a pure refuse parts by using the heavy-media process. In sense of the invention the raw material mentioned above is crushed according to necessity to the grain size of 0 to 50 mm and/or graded. Hereinafter from the raw material and from the weighting material partly being present in the raw material in a quantity of at least 7 weight-%, advantageously 10 weight-%, in a grain size of 0–0.5 mm, partly recycled from the process, a mixture of sludge is prepared in the presence of a liquid phase, while the density of the sludge mixture is adjusted in accordance with the extent of separation. The sludge mixture is allowed to pass through one or more hydrocyclones and equipments separating according to grain-size and/or grading equipments. The density of a part or of the entirety of the streaming suspension is adjusted in accordance with the required density of the sludge mixture, and the suspension in a density thus adjusted is recycled to the sludge production. The product resulting from separation and the suspension not having been recycled are discharged from the system. In case of necessity the process is partly or entirely automatically controlled.

11 Claims, 1 Drawing Sheet

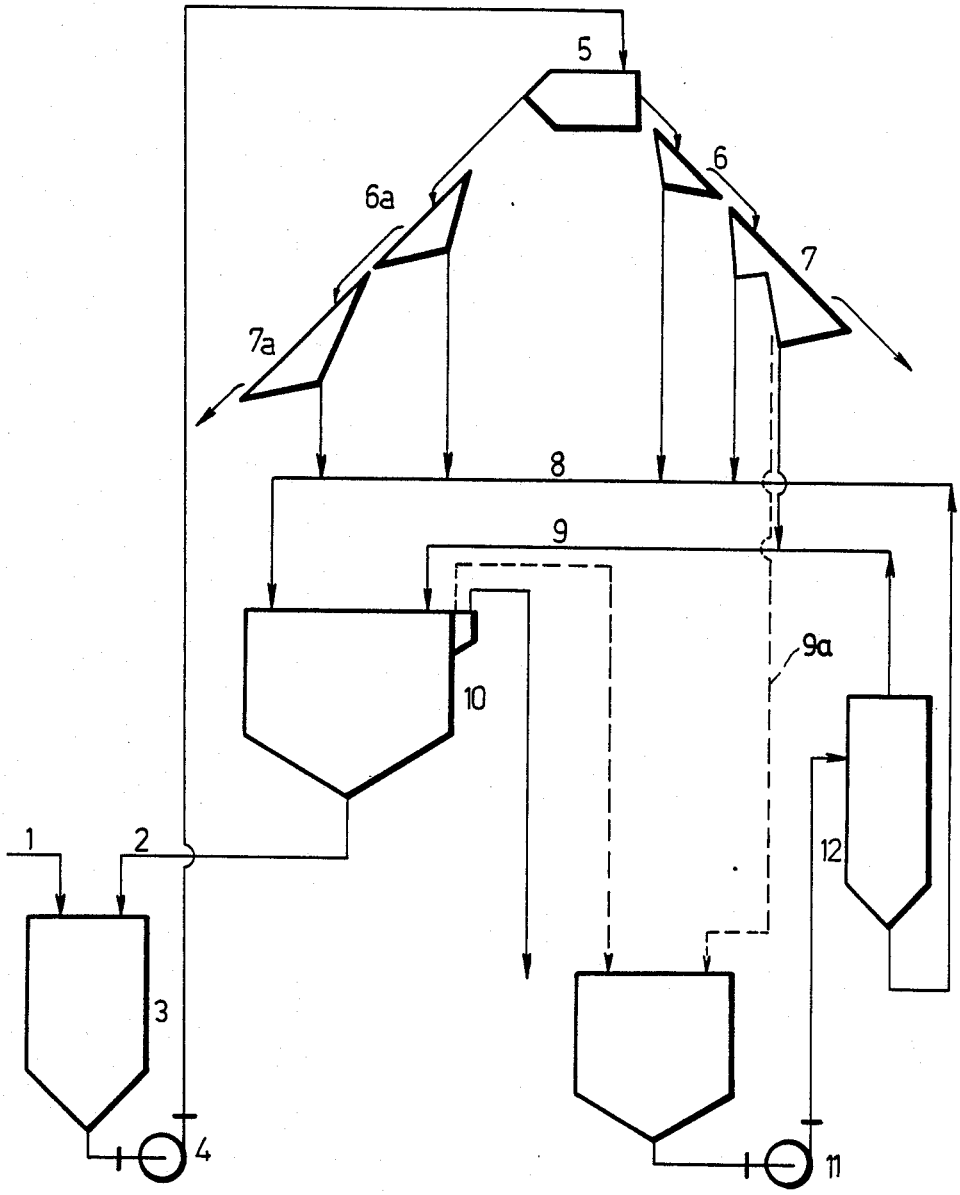
5
6
6a
7
7a
8
9
9a
10
1
2
12
3
4
11

PROCESS FOR THE SEPARATION OF ROCK REFUSE AND COAL PRODUCTS

This is a continuing application of application Ser. No. 670,113, filed on Jan. 8, 1984 which is a continuation of application Ser. No. 552,841, filed on Nov. 14, 1983 which is a continuation of application Ser. No. 423,946, filed on Sept. 27, 1982 which is a continuation of application Ser. No. 319,375, filed on Nov. 9, 1981 which is a copntinuation of application Ser. No. 130,396, filed on Mar. 14, 1980, all now abandoned.

This invention relates to a process for separation of rock refuse and products of coal deposits with rock intercalation—the coal contents of which are advantageously less than 50%—into high-carbon and low-carbon parts, or, in a given case, into pure refuse (barren) parts, through use of the heavy-media process.

In former times, when coal was mined manually, mined products contained relatively small amounts of rock refuse. Even now, in this age of continually increasing mechanized exploitation, this same favorable situation exists when very thick coal deposits, undeteriorated by rock intercalations, are mined. Due to technical reasons the rock refuse content of the mined product inevitably increases in the course of mechanized winning.

Coercive requirements for conservation of energy and energy sources make it necessary to exploit even coal deposits containing large amounts of rock refuse. From time to time, layers, which mainly contain rock refuse, have to be broken through in order to exploit coal deposits lying above or below such layers. Because of operational safety, economic and energy considerations, all available coal sources are mined, even though the amount of rock refuse obtained is, as a result, increased. Moreover, the rock refuse content of products of coal mining may vary considerably over relatively short periods.

Ever increasingly stringent environmental controls prohibit storage of coal containing rock refuse. It is a unnecessary to store such rock refuse since several processes have been proposed for recovering precious components (eg. coal) and for separating and enabling use of the rock refuse content (amounting often to 50–70%) for industrial purposes.

It is well known that separating (washing) processes employed in the "heavy-media process system" are considered to be the most advantageous and successful processes from the standpoint of the quality and quantity of coal recovered. Such processes enable attainment of the density needed for separation (the so-called separating density or, according to previous terminology, the separating specific weight), which cannot be achieved through the exclusive use of water. In order to produce a "heavy suspension", weighting materials are introduced into the system or their presence therein ensured.

Calcium chloride (Lessing), tetra and penta bromethane (Du Pont de Nemours), and $CaCl_2$ solution (M. Bertrand) have been used (mostly in static tanks) for this purpose. To achieve a higher separating density, fine sand has been introduced in the course of the Chance-process; while clay and barytes have been introduced when working with the Sophia Jacoba process. The use of magnetite (Tromp) and the use of loess (Staatsmijnen), for formation of the heavy suspension, have also been proposed.

A common characteristic of each of these processes is that a separate extraneous material is added to the basic material, viz. to the mixture of coal and rock refuse. This serves to further complicate the separating process. From a technological point of view the process becomes burdensome and, in a given case, dependence on other conditions become inevitable. Moreover, economy of the process is reduced.

Consequently, an attempt was made to utilize for formation of the heavy suspension, components already present in the mixture of coal and rock refuse. In order to obtain weighting, such components were produced in separate technological stages and stored and charged separately. Such a process is described in British patent GB-PS 655 957, wherein the light coal component is removed from the fine fraction of the raw coal in an auxiliary cellular flotation machine and the remaining rock refuse is used as weighting material. The process of this British patent is extremely complicated and expensive. Consequently, it has not been well received in industrial practice.

German patent No. 802 690 (corresponding to British patent No. 664 290) discloses a method wherein the coal is separated from the fine parts by flotation and the remaining heavy part is used. The coarse rock refuse is milled to the desired fineness and charged into the system in order to obtain weighting. This method is complicated, expensive and burdensome to control. Consequently, it is seldom used.

Hungarian patent No. 147 558 relates to the processing of waste rock piles containing a maximum of 30% coal. In this patent, extraneous or artificially crushed rock refuse are not employed for recovery of the coal content of the waste rock pile material so as to leave a rock refuse suitable for further industrial processing. The quantity of weighting material needed for separation in the course of the heavy-media process is ensured, according to the process of the Hungarian patent, as follows: " . . . where the crushed material does not contain the grains below 1 mm. needed for processing in cyclones, it should be completed by the fraction of proper grain size, which is separated from the part obtained in the course of a prior processing in the cyclone and enriched in sedimentary rock refuse". Such completion may take place "by introducing the part $<1$ mm. produced in the course of crushing lamps $>80$ mm".

The method of the Hungarian patent may be expediently employed for separation of raw material mixtures with a given coal content, when the raw material mixtures charged for separation contain a considerable proportion (viz. at least 30%) of material having a grain size of up to 1 mm. At the same time, the prescribed distribution of grains below 1 mm must be controlled. When weighting materials meeting such requirements are not available, missing fine grains have to be substituted by previously separated, sedimented and separately "accessorily recycled" fine grains or by the fine fraction crushed from the coarse rock refuse.

With the process of the present invention, all products of coal mining (even those containing 50–70% rock refuse) may be processed. Accordingly, such products contain about 30 to 50% coal with the remainder being rock refuse. In the course of the process of the present invention, considerable quantities of valuable components (eg. useful coal suitable for the purpose of energetics) are separated by means of a method which, compared to prior art methods, is simplier and more economical. In general, the method of the present invention makes it possible to separate parts which are rich or poor in coal content, or to separate, in a given case, a material which is exclusively rock refuse. The fraction enriched in rock refuse can then be processed for different industrial purposes through the use of well known methods.

According to the present invention, a raw material consisting of rock refuse of a coal deposit with rock intercalation, the coal content of which is expediently less than 50%, is separated by means of the heavy-media process into parts respectively rich and poor in coal, or, in a given case, into a prt containing rock refuse exclusively. In the course of the process, the material is ground to a grain size of up to 50 mm. and/or graded. Then a sludge mixture is prepared in the presence of a liquid phase. The sludge is prepared from the raw material and from the weighting material which, in part, is present in the raw material (in an amount of at least 7%, preferably 10%) and, in part, is recycled from the process. During preparation of the sludge mixture, the density of the sludge mixture is adjusted in accordance with the extent of separation. The sludge mixture is then passed through one or more hydrocyclones, apparatus which effects separation according to grain size, and/or grading apparatus. The density of all or part of the flowing suspension is adjusted in accordance with the required density of the sludge mixture. The suspension, with its density thus adjusted, is recycled to the step of sludge production. The product resulting from separation and the suspension which has not been recycled, are discharged from the system. If required, the process may be entirely, or in part, automatically controlled.

In a preferred embodiment of the invention, a raw material, having a total density of at least 2200 kg/m$^3$ and containing a silicate clay mineral and/or any other mineral component as weighting material, is processed.

The liquid phase is produced by using water and/or a suspension.

In order to adjust the density of the suspension and, in a given case, to improve the quality of the coal product, it is advantageous to remove the weighting material adhering to the product (s) separated by washing. The thin suspension, which is thus obtained, can be condensed in a hydrocyclone. The thicker and/or thinner part can be advantageously employed for the adjustment of the density of the suspension.

In a further preferred embodiment, the density of the suspension is adjusted by mixing suspensions of lower and higher densities. Such suspensions are obtained by allowing the suspensions to stream through equipment separating and/or grading according to grain size, e.g. wedge-wire-deck(s) and/or resonance screen(s).

In another preferred embodiment of the invention, the required parameters are continuously or discontinuously measured, and in a given case, recorded and/or automatically controlled.

The present invention is based on the recognition that even raw materials containing lower percentages of coal may be separated into parts which are rich and poor in coal, when the raw material contains weighting material in an amount of at least 7 weight-% and in a grain size of up to 0.5 mm. When such weighting material is collected in the suspension formed during the process and the suspension, or a part thereof, is, after suitable adjustment of density, recycled to the step of sludge production, a separation in a heavy-media process will form. Moreover, the process is a nearly closed system with respect to economy of the weighting material. The weighting material is present in proper quantity. Further, the process operates with its own weighting material (which is contained in suspension in the required quantity) and without a special separating step. Moreover, the weighting material remains in a liquid suspended state upon disposal. The weighting material which remains in the system is capable of repeated utilization. Consequently, the weighting material, which arrives with the raw material in a fragmentary amount, as compared to traditional processes, unforeseeably seems to be sufficient. Simultaneously, the relatively high separating density needed for effective separation can be obtained, even with a raw material having a low coal content. As a matter of fact, the weighting material contained in the raw material is needed only to replace that quantity of raw material discharged with the product due to technical necessity. By practical measurement and realization on an operational level, it can be demonstrated that the weighting material arriving with the raw material and collected in the suspension is not all needed. The surplus may be discharged from the system. Otherwise the density of the suspension and, accordingly, that of the sludge, rapidly increases to an undesireable value whereby the quality of the final product is adversely effected.

The invention will now be described in detail with reference to the examples and the flow diagram of FIG. 1.

A sludge mixture of the required density is produced from raw material 1 and from weighting material which has a grain size of up to 0.5 mm and which is present in raw material 1 and in suspension 2. The sludge mixture is prepared by adding water, at the start of the process, to raw material 1 and the weighting material (not shown in FIG. 1); introducing the resultant mixture into sludge mixing tank 3; then adding thereto suspension 2, as a liquid phase, in the course of a continuous operation. The slude mixture is then charged through pump 4 into hydrocyclone 5.

The density of the sludge mixture should be selected so that the separating density required for separation is formed upon application of the proper pressure in hydrocyclone 5. In hydrocyclone 5, centrifical force causes separation of the raw material into parts which are rich and poor in coal.

At the start of the process, for forming the sludge, water can be exclusively used as the liquid phase. As a consequence, separation with a proper density cannot at first take place. However, within a short time a sludge having the density required for the charge in hydrocyclone 5 can be easily formed by recycling grains of weighting material present in raw material 1 by means of suspension 2 and by collecting the same.

The products which leave hydrocyclone 5 are in the form of a sludge. The sludge also contains the suspension. The product removed from the top of hydrocyclone 5 is rich in coal. This product is led to the separating and grading equipment consisting of wedge-wire deck 6 and resonance screen 7. The sludge containing the screenings which are poor in coal is led to wedgewire deck *6a* and resonance screen *7a*. Wedgewire deck *6a* and resonance screen *7a* serve to separate the solids from the sludge. A thick suspension 8 is formed by draining, after the wedge-wire decks 6, *6a*, the upper section of resonance screen 7 and the upper section of resonance screen *7a*. The weighting material of grain size of up to 0.5 mm which adheres to the product that is rich in coal is washed off in the lower section of resonance screen 7. Consequently, a dilute suspension 9, having lower density, is obtained. Suspension 9 is directed (as shown in FIG. 1 by the dashed line as 9a) to pump 11. Alternatively, it is led along with thick suspension 8 into suspension mixing tank 10. In tank 10, the proper density of suspension 2, which is to be charged into slurry mixing tank 3, is adjusted by mixing the two suspensions in the requisite proportions. Accordingly, the suspension 2, which results, will contain the amount of weighting material necessary for separation.

The suspension that is not utilized for adjustment of density is either removed from the process (viz. system) or led through pump 11 into thickening hydrocyclone 12. The thick and the dilute suspensions which result can, if required, be utilized to adjust the density of suspension 2 in suspension mixing tank 10.

In order to permit optimum recovery and utilization of the weighting material present in the raw material and in the suspension, the process is automatically controlled. In addition to continuity of the sludge stream, all required parameters are measured and controlled so as to ensure the requisite charging of the weighting material required by the process.

Operation of the process of the present invention will now be illustrated by means of the following examples.

EXAMPLE 1

The raw material, a typical Silesian rock refuse of the carbonic period and containing clay-state, was crushed to a grain size of up to 50 mm and graded. The coal content of the raw material was 10%. Additionally, prior to sludge formation, the raw material contained 7 weight-% weighting material having a grain size of up to 0.5 mm.

The charged raw material was processed in a plant operating in accordance with the invention and having a charging capacity of 120 ton/hour. At the end of the process, 10.2 tons/hour of 8.5% coal rich fraction and 101.4 tons/hour of 84.5% coal poor fraction (which could be considered from a practical standpoint to be refuse) were obtained. At the end of the process, 7 weight-% of the total amount of weighting material charged had left the system. The loss of this material was from a technical standpoint unavoidable. One half of the loss was attributable to material adhering to the solid product. The other half of the lost material was present in the suspension. This portion of the suspension possessed an outlet density of 1070 kg/m$^3$/ and did not have to be recycled any longer into the sludge production. The weighting material contained in the raw material fed into the system covered the amount of weighting material lost from the system due to technical reasons, thereby maintaining balance within the system. The recycled suspension always possessed the required density of 1186 kg/m$^3$. The quantity of the weighting material used in the system remained unchanged, while the density needed for separation, i.e. 1300 kg/m$^3$ could be continuously ensured by charging 120 tons of solid material per hour into the system.

EXAMPLE 2

A raw material from the waste rock pile in the environment of the Belgian Charleroi was charged into a plant, having the same capacity and at the same separating density, as described in Example 1. The raw material contained 6% coal and 14 weight-% weighting material (based on the amount of shale rock) having a grain size of up to 0.5 mm. Accordingly, the amount of weighting material amounted to 16.8 tons/hour.

At the end of the process, 3.5 weight-%, 4.2 tons/-hour weighting material was discharged together with the separated product. In addition, 12.6 tons/hour weighting material had to be discharged along with the suspension (which had a density of 1180 kg/m$^3$), in order to maintain the density of the recycled suspension at the desired level, i.e. 1186 kg/m$^3$. At the end of the process, 6.48 tons/hour, 5.4% fraction rich in coal and 96.72 tons/hour, 80.6% fraction poor in coal (which could from a practical standpoint be considered as refuse) were obtained.

EXAMPLE 3

A rock refuse of brown coal from the coal deposit in Tatabanya (coal content 40%) was evaluated under similar conditions and in the same plant as described in Examples 1 and 2. After the necessary preparatory steps were carried out, the raw material contained 21% of loamy weighting material having a grain size of up to 0.5 mm.

As in the processes of Examples 1 and 2, in respect to the weighting material, the system worked in a "self-supplying" manner. For technical reasons, however, weighting material in a quantity of 21.0 tons/hour had to be discharged in the suspension having a density of 1270 kg/m$^3$. Otherwise, the separating density (1.3) of the process would have been changed and, as a consequence, the quality of the coal would have been altered. At the end of the process, the yield amounted to 45.6 tons/hour, 38% fraction rich in coal and 53.4 tons/-hours, 41% fraction poor in coal (wich from a practical standpoint could be considered to be refuse).

In all three examples, the plant was operated automatically so as to maintain technological densities. Moreover, all required parameters were measured and controlled by momentary values within the system.

The main advantages of the system of the present invention may be summarized as follows:

1. The process enables the processing of raw materials of coal mining, which either have not been previously exploited or which have been stored for short or long periods in overground waste rock piles or which could be separated only by using complicated and more expensive methods or less efficient methods.

2. The process does not require a special extraneous weighting material. The weighting material contained in the raw material does not have to be separated by means of special technical steps and charged into the system in proper quantity. It suffices that the weighting material arrives, in its natural state and in an amount that is far less than that which is usually employed, along with the raw material to be processed. Alternatively, the mechanical preparatory processing of the raw material should ensure the presence therein and availability of the weighting material in the requisite grain size.

The quantity of weighting material needed for maintaining the required density is continuously kept in the system by means of the recycled suspension. As a matter of fact, the weighting material contained in the raw material serves only to replace the weighting material lost as a result of being discharged from the system for technical reasons. For this purpose, an amount of 7%, advantageously 10%, seems to be sufficient. Moreover, in a given case, even a larger amount of superfluous weighting material can be removed from the system.

3. Compared to preveously used processes, the process according to the present invention is simpler and more economical. Namely, it enables the separation of raw materials containing fine grains (up to 0.5 mm) in a limited quantity without the need for producing fine grains in an amount surpassing the above given value, which is leaving the system anyhow.

4. Coal, having a constant calometric value, and rock refuse, useful for industrial purposes in the usual manner, are obtained as final products. In a given case, it is possible to perform separation into other products rich and poor in coal, respectively (e.g. raw materials for brick production).

5. Water economics of the process are also advantageous. Because the suspension is recycled, consumption of water for production of sludge is practically minimal. That means that fewer suspended solids leave the system. This is very important from an environmental-control point of view.

Although the process according to the invention has been described by way of concrete examples, several other modes of performance exist within the scope of the invention defined by the claims.

What we claim is:

1. In a process for separating from a raw material low in coal content and high in rock refuse content using the heavy media process to recover a first fraction rich in coal content and a second fraction enriched in rock refuse content which is ready for processing for different industrial purposes, which process does not require the introduction of extraneous weighting material, the improvement comprising using as the weighting material for said heavy media process, fine grained non-coal mineral ingredients contained in said raw material, said raw materia consisting of coal containing rock refuse from coal mining and/or a product of a coal deposit having rock intercalation, said raw material having a coal content of less than 50% and which has or is treated to have a maximum particle size of 50 mm and containing at least 7% by weight of said weighting material which has a maximum particle size of 0.5 mm;

(a) mixing in a first container said raw material with an aqueous suspension of weighting material obtained by the recirculation from a subsequent step in the process to form a feed sludge suspension having a separation density of about 1300 kg/m$^3$, the grain size for the weighting material in said raw material and in said aqueous suspension being up to 0.5 mm;

(b) introducing said feed sludge suspension into a hydrocyclone wherein said feed sludge is separated into a coal rich sludge and a coal poor sludge;

(c) passing said coal poor sludge over a first screen and collecting a first suspension that passes through said first screen;

(d) passing said coal rich sludge through a second screen and collecting a second suspension passing through said second screen, a coal rich fraction being retained on said second screen;

(e) commingling said second suspension with said first suspension thereby constituting heavy suspension;

(f) washing said coal rich fraction collected on said second screen to remove weighting material adhered thereto which has a grain size up to 0.5 mm;

(g) collecting the washings from step (f) containing said weighting material to form a lighter suspension;

(h) automatically mixing said heavy suspension with said lighter suspension in a second container in such proportions as to form a suspension containing the required density of about 1186 kg/m$^3$;

(i) recirculating the suspension formed from step (h) to said first container where it is mixed with said raw material in such proportions as to form a feed sludge having a separation density of about 1300 kg/m$^3$;

whereby said recirculated suspension, mixed with said raw material that includes said at least 7% of weighting material having a maximum particle size of 0.5 mm, together comprise the weighting material used in the process and wherein approximately the same amount of solid material is removed from the process as is introduced into the process with the raw material, and thus the amount of solids circulating within the process remains relatively constant.

2. A system according to claim 1 wherein at least a portion of said lighter suspension of (g) is fed to a thickening hydrocyclone to form a thick and thin suspension which are fed to said second container in such proportions as to aid in adjusting the density of the suspension in said second container to a level of about 1186 kg/m$^3$.

3. A process according to claim 1 wherein the coal content of said raw material is 10% and said weighting material content is 7%.

4. A process according to claim 1 wherein the coal content of the raw material is 6% and the weighting material content is 14%.

5. A process according to claim 1 in which the coal content of said raw material is 40% and the weighting material content is 21%.

6. A process according to claim 2, wherein the coal content of said raw material is 10% and said weighting material content is 7%.

7. A process according to claim 2, wherein the coal content of the raw material is 6% and the weighting material content is 14%.

8. A process according to claim 2, in which the coal content of said raw material is 40% and the weighting material content is 21%.

9. A process for separating a coal containing rock material into a first rock fraction that is rich in coal and into a second rock fraction that is poor in coal, which comprises mixing a starting material consisting essentially of coal-containing rock that contains not more than 50% by weight coal, said starting material having a maximum particle size of 50 mm, and at least 7% by weight of said starting material comprises rock particles having a maximum particle size of 0.5 mm, with a suspension having a preadjusted density, the solids content of said suspension originating entirely from the starting material, introducing the resulting mixture into a hydrocyclone, passing the material obtained from the hydrocyclone through a sieve while separating coal rich and coal poor fractions, respectively, adjusting the suspension flowing through the sieve to have a preselected density, and then recirculating the suspension to be mixed with new starting material.

10. The process of claim 9, further comprising thickening the suspension flowing through the sieve to obtain a thickened fraction, and applying said thickened fraction and/or unthickened fractions of said suspension for adjusting the density thereof.

11. The process of claim 9, wherein small particles of rock material adhered to the surface of coal in said coal rich fraction, are washed through said sieve.

* * * * *